US008820691B2

(12) United States Patent
Bednarz et al.

(10) Patent No.: US 8,820,691 B2
(45) Date of Patent: Sep. 2, 2014

(54) ADJUSTABLE SUPPORT STRUCTURE FOR AN AFTER-TREATMENT COMPONENT

(75) Inventors: Stephen M. Bednarz, De Kalb, IL (US); Satyajit Gowda, Willowbrook, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 0 days.

(21) Appl. No.: 13/536,395

(22) Filed: Jun. 28, 2012

(65) Prior Publication Data

US 2014/0000745 A1 Jan. 2, 2014

(51) Int. Cl.
*F16M 11/02* (2006.01)

(52) U.S. Cl.
USPC ..... 248/295.11; 123/65 EM; 123/65 A; 248/205.1

(58) Field of Classification Search
USPC ..... 123/65 EM, 65 PE, 65 A, 195 R, 217, 123/216, 65 P; 60/597, 605.1, 605.2, 39.5, 60/311, 299, 297, 272; 55/DIG. 30, 523, 55/385.1, 385.3, 584; 422/169, 172; 29/890.08; 181/213; 180/89.2, 309; 285/24, 365; 248/65, 295.11, 205.1, 248/610; 137/343
See application file for complete search history.

(56) References Cited

U.S. PATENT DOCUMENTS 5,008,086 A 4/1991 Merry
5,082,479 A 1/1992 Miller
6,508,491 B1 * 1/2003 Ebinger et al. ..... 285/223
6,537,355 B2 3/2003 Scardino et al.
7,160,361 B2 1/2007 Meiller et al.
7,517,380 B2 4/2009 Grimm et al.
7,617,685 B2 * 11/2009 Norman et al. ..... 60/770
7,779,624 B2 8/2010 Belisle et al.
7,886,542 B2 * 2/2011 Blanchard et al. ..... 60/761
8,052,770 B2 11/2011 Ayshford et al.
2011/0030353 A1 * 2/2011 Kamiya et al. ..... 60/297
2011/0167808 A1 7/2011 Kosaka et al.
2011/0181037 A1 7/2011 Griffin et al.
2012/0012731 A1 * 1/2012 Johnson ..... 248/638
2012/0273648 A1 * 11/2012 Maske et al. ..... 248/636

FOREIGN PATENT DOCUMENTS

JP 2011196194 9/2011
KR 864570 B1 10/2008
WO WO 2011/087641 7/2011

* cited by examiner

*Primary Examiner* — Noah Kamen
*Assistant Examiner* — Long T Tran
(74) *Attorney, Agent, or Firm* — Finnegan, Henderson, Farabow, Garrett & Dunner LLP

(57) ABSTRACT

An adjustable support structure for an after-treatment component is disclosed. The adjustable support structure may have a housing wall. The adjustable support structure may also have a plate. The plate may have a base edge fixedly connected to the housing wall. The plate may also have a distal edge. The adjustable support structure may also have a bracket connected to the plate at the distal edge. The bracket may be configured to engage the after-treatment component. The adjustable support structure may also have first and second legs extending from the bracket toward the housing wall. The first and second legs may be spaced apart from each other to receive the distal edge of the plate therebetween.

20 Claims, 6 Drawing Sheets

ADJUSTABLE SUPPORT STRUCTURE FOR AN AFTER-TREATMENT COMPONENT

TECHNICAL FIELD

The present disclosure relates generally to an adjustable support structure and, more particularly, to an adjustable support structure for an after-treatment component.

BACKGROUND

Internal combustion engines generate exhaust as a by-product of fuel combustion within the engines. Engine exhaust contains, among other things, unburnt fuel, particulate matter such as soot, and harmful gases such as carbon monoxide or nitrous oxide. To comply with regulatory emissions control requirements, engine exhaust must be cleaned before it is discharged into the atmosphere.

Engines typically include after-treatment devices that remove or reduce harmful gases and particulate matter in the exhaust. For example, a diesel engine can be equipped with a diesel oxidation catalyst (DOC) that promotes oxidation of unburnt fuel, carbon monoxide and/or nitrous oxide, and a diesel particulate filter (DPF) that traps particulate matter. Over time, the increasing volume of trapped soot impedes the flow of exhaust through the DPF and degrades engine performance. One commonly used technique for in-situ cleaning or regeneration of the DPF involves raising the temperature of the DPF above a combustion or oxidation threshold of the soot particles accumulated on the DPF. In most cases, this is achieved by heating the exhaust before it enters the DPF. One technique of heating the exhaust consists of injecting fuel into the exhaust and oxidizing it in the presence of a DOC located upstream from the DPF. Heat generated from the oxidation reaction heats the exhaust as it flows through the DOC before entering the DPF. When the soot particles in the DPF come into contact with hot exhaust, they oxidize.

To ensure that heated exhaust can flow through a DOC into a DPF, one end of the DPF may be fixedly attached to the DOC. The DPF may also be attached, nearer its other end, to a wall of an exhaust passage using support structures. To ensure that mating parts on the DPF and on the support structures align correctly during assembly, it is necessary to maintain tightly controlled machining tolerances on the mating parts. When an engine includes more than one DPF, stringent control on machining tolerances becomes even more necessary to ensure that DPFs can be assembled interchangeably in any of the multiple DPF locations. Alternatively, it is possible to match each DPF to a DOC and a corresponding support structure and assembly location to reduce the potential for mismatch between mating surfaces. Maintaining tight machining tolerances, however, increases the cost of manufacturing both the DPF and the support structures, and also increases the cost of any replacement parts.

One attempt to address the problems described above is disclosed in U.S. Patent Publication No. 2011/0167808 of Kosaka et al. that was published on Jul. 14, 2011 ("the '808 publication"). In particular, the '808 publication discloses a support structure for an exhaust gas treatment apparatus. The support structure of the '808 publication includes vertical support stays installed on the front and back sides of an engine body. In addition, the support structure of the '808 publication includes two support brackets. The ends of each support bracket are attached to the support stays using fasteners passing through elongated slots. The elongated slots in the support structure allow for bi-directional adjustment of the relative positions of each support bracket with respect to the support stays. An exhaust gas treatment apparatus is attached to the two support brackets using oversized holes for alignment with corresponding fastener holes on the support brackets.

Although the '808 publication discloses a support structure that provides some adjustability via the elongated slots and oversized holes, the adjustability may be limited. For example, the support structure of the '808 publication may permit only a limited amount of adjustment in a direction perpendicular to a plane formed by the brackets. Similarly, the support structure of the '808 publication may not be able to accommodate any angular mismatch between the exhaust gas treatment apparatus and the support brackets, about an axis perpendicular to the plane formed by the support brackets. Further, the support structure of the '808 publication may not allow for thermal expansion of the components. For example, an increase from an ambient temperature to an operating temperature may cause thermal expansion of the exhaust gas treatment apparatus, and the rigid support structure of the '808 publication may limit the amount of dimensional change. This could induce stresses, which may damage or even break components of the exhaust gas treatment apparatus.

The adjustable support structure of the present disclosure solves one or more of the problems set forth above and/or other problems in the art.

SUMMARY

In one aspect, the present disclosure is directed to an adjustable support structure for an after-treatment component. The adjustable support structure may include a housing wall. The adjustable support structure may also include a plate. The plate may include a base edge fixedly connected to the housing wall. The plate may also include a distal edge. The adjustable support structure may also include a bracket connected to the plate at the distal edge. The bracket may be configured to engage the after-treatment component. The adjustable support structure may also include first and second legs extending from the bracket toward the housing wall. The first and second legs may be spaced apart from each other to receive the distal edge of the plate therebetween.

In another aspect, the present disclosure is directed to an adjustable support structure for an after-treatment component. The adjustable support structure may include a housing wall. The adjustable support structure may also include a first plate having a base edge, a first distal edge, and a second distal edge. The adjustable support structure may also include a second plate having a base edge, a first distal edge, and a second distal edge, wherein the second plate is spaced apart from the first plate. The adjustable support structure may also include a first bracket connected to the first and second plates at the first distal edges and configured to engage the after-treatment component. The adjustable support structure may also include a second bracket connected to the first and second plates at the second distal edges and configured to engage the after-treatment component. The adjustable support structure may also include first and second legs extending from the first bracket towards the housing wall. The first and second legs may be spaced apart from each other to receive the first distal edges of the first and second plates therebetween. The adjustable support structure may also include third and fourth legs extending from the second bracket towards the housing wall. The third and fourth legs may be spaced apart from each other to receive the second distal edges of the first and second plates therebetween.

DETAILED DESCRIPTION

Figure 1:
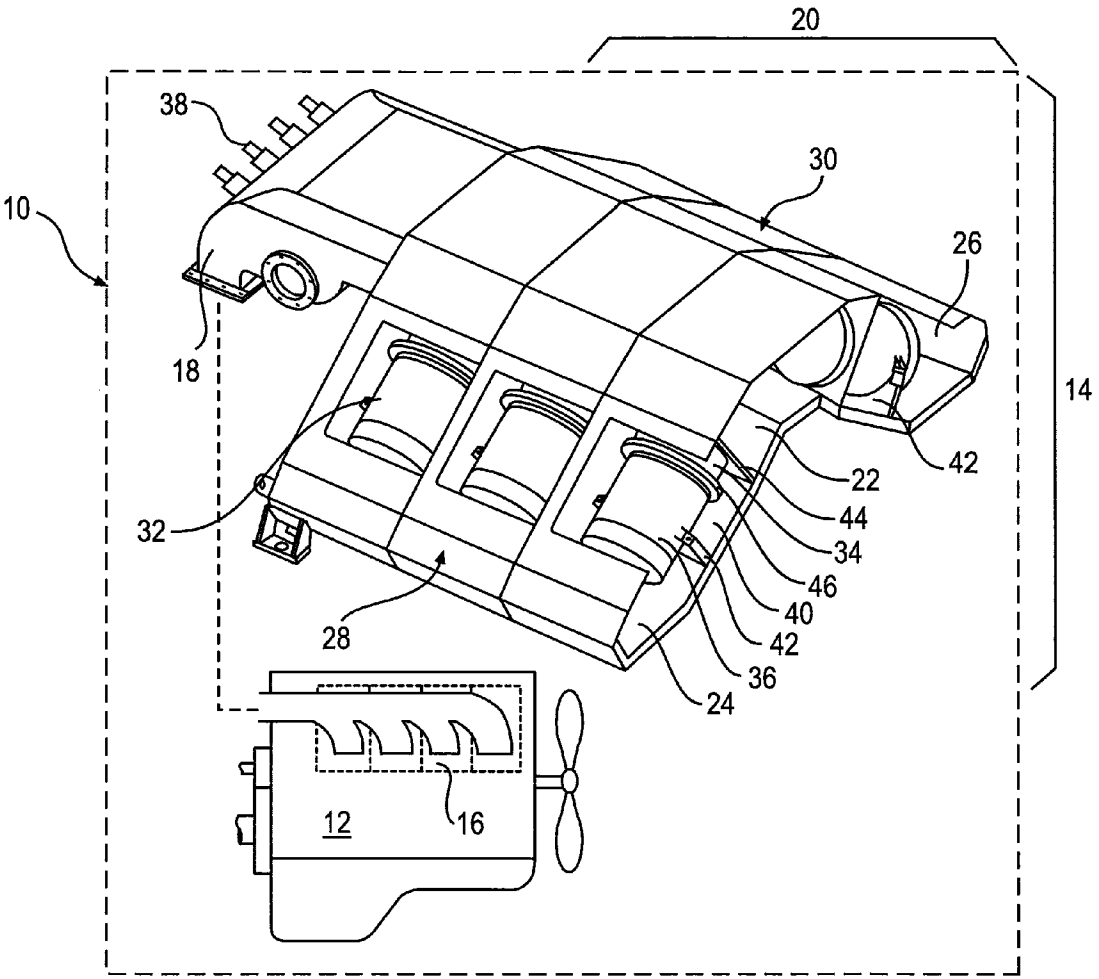
FIG. 1 is a pictorial illustration of an exemplary disclosed machine.

FIG. 1 illustrates a machine 10 having an engine 12 and an exhaust system 14. Machine 10 may be a fixed or mobile machine that performs some type of operation associated with an industry such as railroad, marine, mining, construction, farming, power generation, or any other industry known in the art. For example, machine 10 may embody a locomotive, a marine vessel, an earth moving machine, a generator set, a pump, or another suitable operation-performing machine.

In one exemplary embodiment of machine 10, engine 12 may be a two-stroke diesel engine. One skilled in the art will recognize, however, that engine 12 may be any other type of internal combustion engine such as, for example, a four-stroke diesel engine, a gasoline engine, or a gaseous-fuel powered engine. Engine 12 may include an engine block that at least partially defines a plurality of cylinders 16. The plurality of cylinders 16 in engine 12 may be disposed in an "in-line" configuration, a "V" configuration, or in any other suitable configuration. Although FIG. 1 illustrates an engine 12 with four cylinders 16, one skilled in the art would understand that engine 12 may have any number of cylinders 16.

Engine 12 may be fluidly connected to exhaust system 14, which may include multiple fluid paths that direct exhaust from cylinders 16 to the atmosphere. For example, exhaust from cylinders 16 may discharge to a diffuser 18 and pass from diffuser 18 into an after-treatment system 20. After-treatment system 20 may have a plenum 22, which may separate into two separate discharge passages 24 and 26, which discharge exhaust to the atmosphere. Exhaust treatment components may be located between plenum 22 and discharge passages 24 and 26.

The exhaust treatment components located between plenum 22 and discharge passages 24, 26 may include, among other things, a first filter bank 28 and a second filter bank 30. First and second filter banks 28, 30 may each include one or more after-treatment components 32 attached at one end to end wall 44. Although FIG. 1 illustrates an exemplary embodiment with three after-treatment components 32 in each of the first and second filter banks 28, 30, one skilled in the art would understand that first and second filter banks 28, 30 may have any number of after-treatment components 32. In one exemplary embodiment, after-treatment components 32 may be oriented such that a direction of exhaust flow through after-treatment components 32 may be generally orthogonal to a direction of exhaust entering and exiting after-treatment system 20.

Each after-treatment component 32 may include a diesel oxidation catalyst (DOC) 34 and a diesel particulate filter (DPF) 36. Exhaust from plenum 22 may flow through DOCs 34 and DPFs 36 into discharge passages 24, 26. One or more dosers 38 associated with diffuser 18 may inject fuel into the exhaust upstream from DOCs 34. The injected fuel may oxidize in the presence of DOCs 34. Heat generated as a result of the oxidation reaction may heat exhaust flowing through DOCs 34. Soot trapped in DPFs 36 may come into contact with the heated exhaust and oxidize.

DOC 34 may include a flow-through substrate having, for example, a honeycomb structure with parallel channels for the exhaust to flow through. A catalytic coating (for example, of a platinum group metal) may be applied to the surface of the substrate to promote oxidation of some constituents (such as, for example, hydrocarbons, carbon monoxide, oxides of nitrogen, etc.) of exhaust as it flows through DOC 34. The honeycomb structure of the substrate in DOC 34 may increase the contact area of the substrate to the exhaust, allowing more of the undesirable constituents to be oxidized as exhaust passes through DOC 34.

DPF 36 may be a device used to physically separate soot or particulate matter from exhaust as it flows through DPF 36. In the disclosed embodiment, DPF 36 may include a wall-flow substrate. Exhaust may pass through walls of DPF 36, leaving larger particulate matter accumulated on the walls. Over time, DPF 36 may become overloaded with trapped soot, which may impede the flow of exhaust through DPF 36. DPF 36 may be cleaned by raising a temperature of DPF 36 above the combustion or oxidation threshold of the accumulated soot. In one exemplary embodiment, the threshold temperature may be about 500° C. to 650° C.

As shown in FIG. 1, DOC 34 may be attached to an end wall 44 of plenum 22 using fasteners (not shown). Alternatively, DOC 34 may be attached to end wall 44 by welding, brazing, or by any other appropriate means of attachment known in the art. DPF 36 may be attached to DOC 34. A variety of attachment methods may be used to attach DPF 36 to DOC 34. For example, a clamp 46 may be used to attach DPF 36 to DOC 34. It is contemplated, however, that fasteners, or any other appropriate means of attachment may be used to attach DPF 36 to DOC 34. DPF 36 may also be attached to a housing wall 40 of discharge passages 24, 26 using adjustable support structures 42. DPF 36 may be periodically removed for cleaning, inspection and maintenance by disassembling clamp 46 and detaching DPF 36 from adjustable support structure 42.

Figure 2:
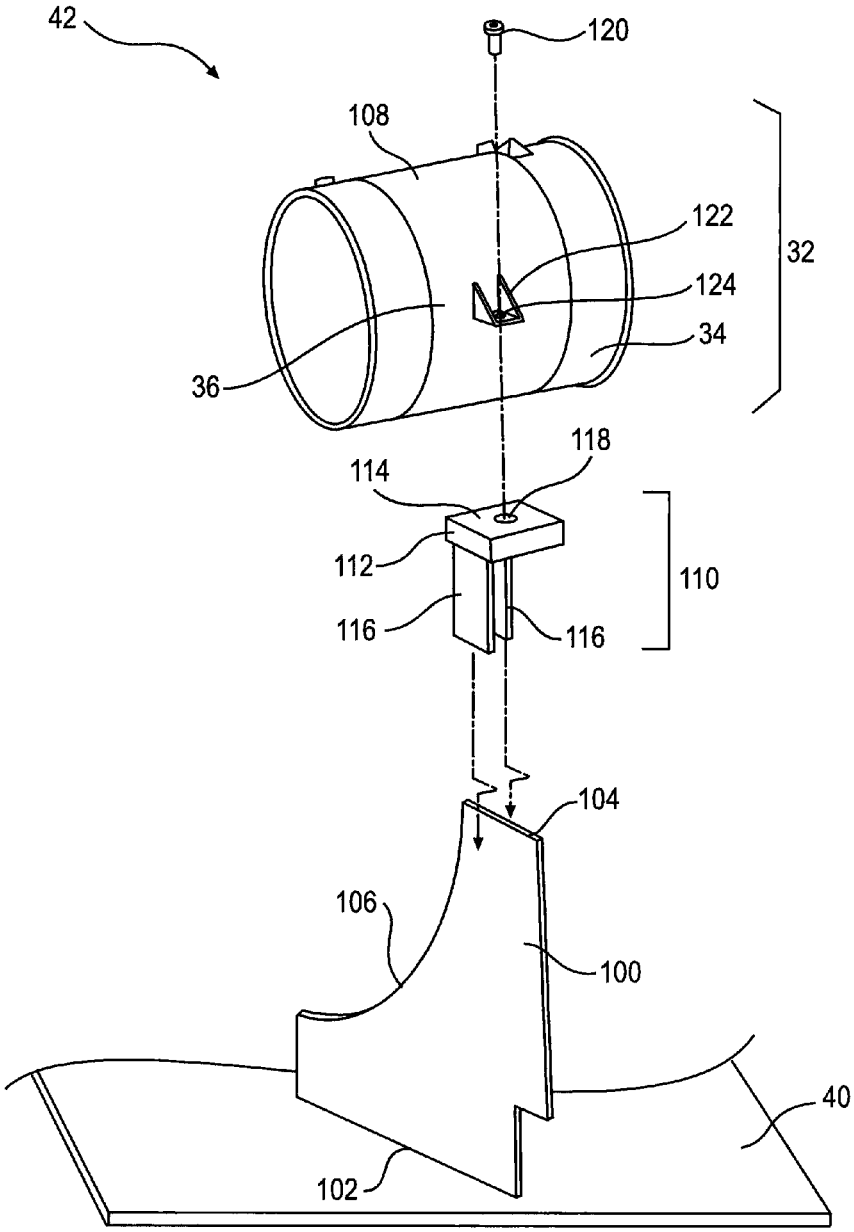
FIG. 2 is a pictorial illustrations of an exemplary disclosed adjustable support structure used in the machine of FIG. 1.

FIG. 2 illustrates an exemplary embodiment of adjustable support structure 42. Adjustable support structure 42 may include a plate 100 having a base edge 102 and a distal edge 104. Plate 100 may be attached to housing wall 40 of discharge passages 24, 26. In one exemplary embodiment, plate 100 may be fixedly attached to housing wall 40 by a welded joint. It is contemplated, however, that plate 100 may be attached to housing wall 40 using fasteners, or any other appropriate method of attachment known in the art. Plate 100 may be attached to housing wall 40 such that plate 100 is generally orthogonal to a longitudinal axis of after-treatment component 32. It is contemplated, however, that plate 100 may be oriented at any arbitrary angle with respect to the longitudinal axis of after-treatment component 32.

A bracket 110 may be connected to distal edge 104 of plate 100. Bracket 110 may have a mounting member 112 which may have a mounting surface 114. Bracket 110 may also have legs 116 attached at a side opposite to mounting surface 114. Legs 116 may be spaced apart to receive distal edge 104 of plate 100.

A thickness and/or length of plate 100 may be selected such that plate 100 may bend in a direction orthogonal to a plane of plate 100. In one exemplary embodiment, plate 100 may have a thickness of about 0.06 to 0.12 inches and a length of about 6 to 10 inches.

DPF 36 and DOC 34 may undergo thermal expansion as a temperature of DPF 36 and DOC 34 increases from an ambient temperature to an operating temperature. In particular, while DOC 34 remains fixedly attached to end wall 44, after-treatment component 32 may increase in length along its longitudinal axis, as a result of thermal expansion. As a result, distal edge 104 of plate 100 may deflect orthogonal to the plane of plate 100. In one exemplary embodiment, a temperature of DPF 36 may change from an ambient temperature to about 650° C. during normal operation of engine 12 and to about 1200° C. during a regeneration event. As a result, distal edge 104 of plate 100 may deflect by about 0.0625 to 0.1875 inches.

Allowing plate 100 to bend orthogonal to its plane may permit adjustable support structure 42 to absorb the dimensional change in DPF 36 and DOC 34, without subjecting these components to additional thermally induced stresses. Thus, in the disclosed embodiment, bending of plate 100 orthogonal to its plane may help prevent damage to DOC 34 and DPF 36 due to thermally induced stresses.

A width of plate 100 at base edge 102 may be larger than a width of plate 100 at distal edge 104. Making the width of plate 100 larger at base edge 102 may help reduce an amount of stress that plate 100 must withstand as a result of deflection of distal edge 104 due to thermal expansion of DPF 36 and DOC 34. Further, the width of plate 100 adjacent to base edge 102 may be selected to help ensure that plate 100 can withstand the stresses induced due to loads generated in the plane of plate 100. In one exemplary embodiment, loads of up to about 5 g may be induced in the plane of plate 100 due to operation of machine 10. Edge 106 of plate 100 may be shaped to accommodate an outer surface 108 of DPF 36. For example, as shown in FIG. 2, edge 106 may have a generally circular shape to match the cylindrical shape of outer surface 108 of DPF 36.

Mounting member 112 may consist of a rectangular or square metallic piece. It is contemplated, however, that mounting member 112 may have a circular, triangular, polygonal, or any other kind of shape. One skilled in the art would also recognize that mounting member 112 may be made of any material (metallic or non-metallic) that can withstand the temperature in discharge passages 24, 26 during operation of machine 10. Mounting surface 114 may be machined to be generally flat. The thickness of mounting member 112 may be selected to ensure mounting member 112 can withstand stresses induced during operation of machine 10. Mounting member 112 may also have an opening 118 sized to allow a fastener 120 to pass through opening 118. In one exemplary embodiment, opening 118 may be threaded and fastener 120 may have threads that mate with the threads in opening 118. In another exemplary embodiment, fastener 120 may pass through opening 118 and a nut (not shown) may be attached to fastener 120. Mounting surface 114 of bracket 110 may be generally orthogonal to the plane of plate 100. Orienting the mounting surface in this manner may make it easier to mate a corresponding surface on DPF 36 with mounting surface 114 during assembly of DPF 36. One skilled in the art would recognize, however, that mounting surface 114 may be disposed at an angle with respect to the plane of plate 100 to match a correspondingly angled mating surface on DPF 36, if necessary.

Legs 116 may consist of rectangular protrusions from bracket 110. It is contemplated, however, that legs 116 may have any appropriate shape and may be made out of any appropriate material (metallic or non-metallic) capable of withstanding the temperature in discharge passages 24, 26. Legs 116 may be movably attached to mounting member 112. In one exemplary embodiment, legs 116 may be attached to mounting member 112 using screws (not shown) that may be only finger-tightened to allow relative movement between legs 116 and mounting member 112 during assembly. Legs 116 may be disposed orthogonal to mounting surface 114. It is contemplated, however, that legs 116 may be alternatively disposed at another desired angle with respect to mounting surface 114, if desired. Legs 116 may be spaced apart to receive a distal edge 104 of plate 100 therebetween. In one exemplary embodiment, legs 116 may be disposed parallel to each other. It is contemplated, however, that legs 116 may be disposed at another desired angle with respect to each other, if desired. Further, it is contemplated that legs 116 may be shaped so that legs 116 may apply a spring force on plate 100 to hold bracket 110 in a desired position on plate 100.

DPF 36 may have an ear 122 configured to mate against mounting surface 114. Ear 122 may have an opening 124 and a fastener may pass through opening 124 in ear 122 and opening 118 in bracket 110 to attach ear 122 to bracket 110.

Figure 3:
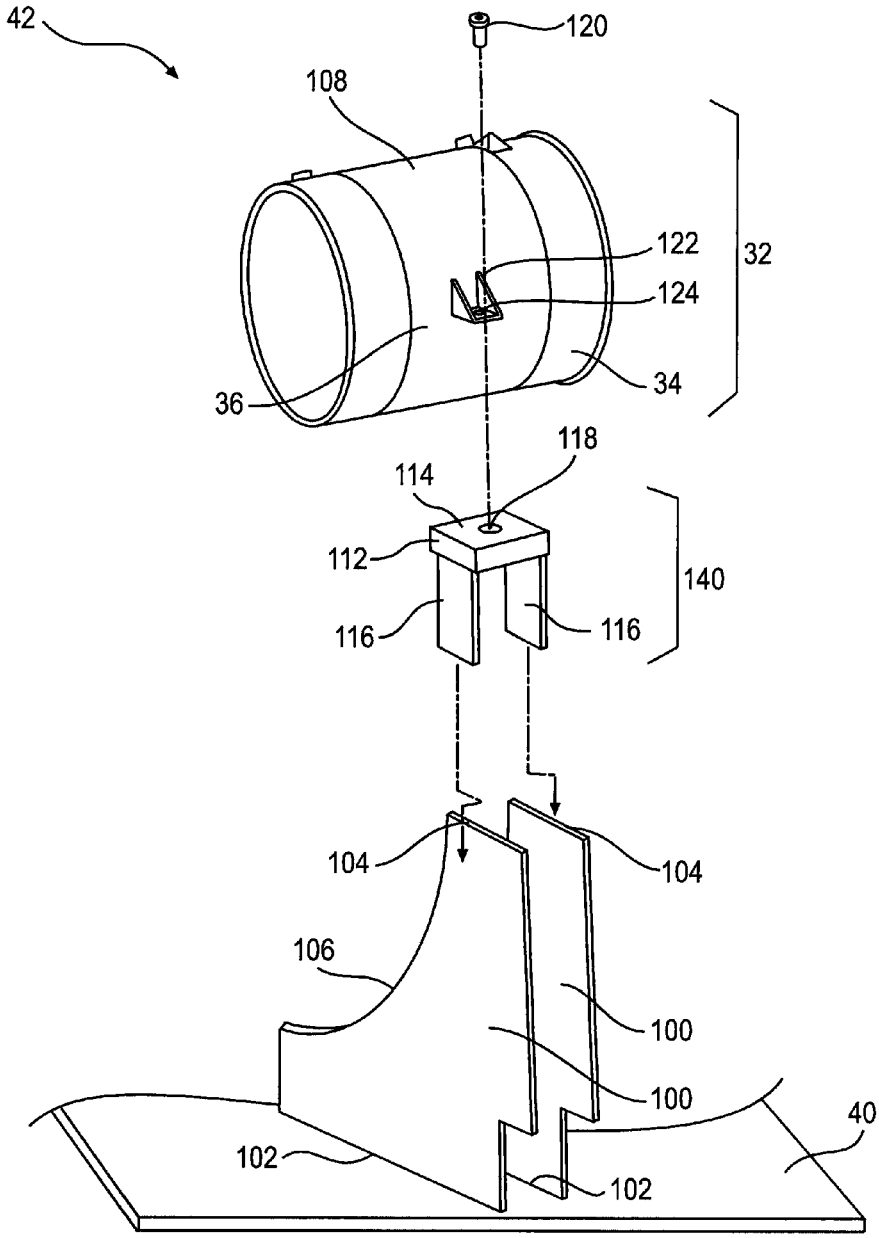
FIGS. 3, 4, 5, and 6 are additional pictorial illustrations of adjustable support structures used in the machine of FIG. 1.

FIG. 3 illustrates another exemplary embodiment of adjustable support structure 42. As shown in FIG. 3, adjustable support structure 42 may consist of two plates 100. Two plates 100 may be used when the anticipated load generated in the plane of plates 100 due to operation of machine 10 is so large that one plate 100 may be insufficient to withstand the load. Legs 116 of bracket 140 in FIG. 3 may be spaced apart to receive both plates 100. Further, plates 100 may be spaced apart from each other to provide sufficient clearance for fastener 120 to pass through opening 118 and be disposed between plates 100. In one exemplary embodiment, plates 100 may be disposed parallel to each other. It is contemplated, however, that the plates 100 may be alternatively oriented at an angle with respect to each other. Plates 100 may be angled to limit the amount of deflection of distal edges 104 due to thermal expansion of DPF 36 and DOC 34. Plates 100 may have the same or different thickness, same or different lengths, and same or different widths at base edges 102 and distal edges 104. Similarly, plates 100 may be made of the same or different material. Bracket 140 may be movably attached to distal edges 104 of plates 100. Bracket 140 may provide the same degree and type of positional adjustment as that provided by bracket 110 described above. Adjustable support structures 42 shown in FIGS. 2 and 3 may be disposed on either side or both sides of DPFs 36 to support DPFs 36 in machine 10.

Figure 4:
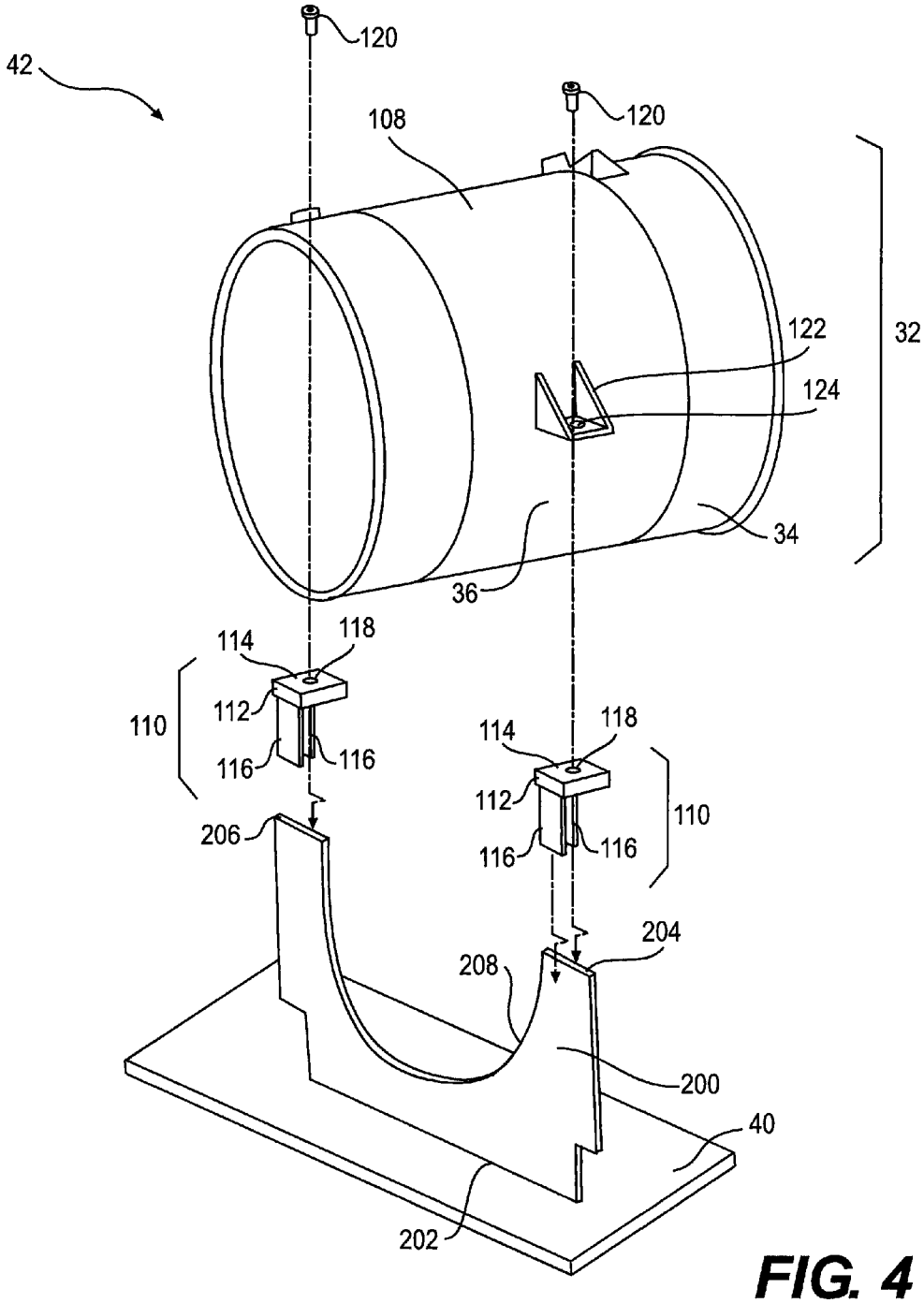

FIG. 4 illustrates another exemplary embodiment of adjustable support structure 42. In this disclosed embodiment of adjustable support structure 42, plate 100 has been replaced with plate 200 attached to housing wall 40. Plate 200 may have a bottom edge 202, a first distal edge 204, and a second distal edge 206. An internal edge 208 of plate 200 may extend between first distal edge 204, and second distal edge 206. Brackets 110 may be attached to first distal edge 204, and second distal edge 206. First and second fasteners 120 may attach ears 122 on DPF 34 to brackets 110. As shown in FIG. 4, a shape of edge 208 may be selected to accommodate a shape of outer surface 108 of DPF 36. In one exemplary embodiment, edge 208 of plate 200 may have a generally circular profile. The operation and construction of plates 200 and brackets 110 of FIG. 4 may be substantially identical to that of plates 100 and brackets 110 described above with reference to FIG. 2.

Figure 5:
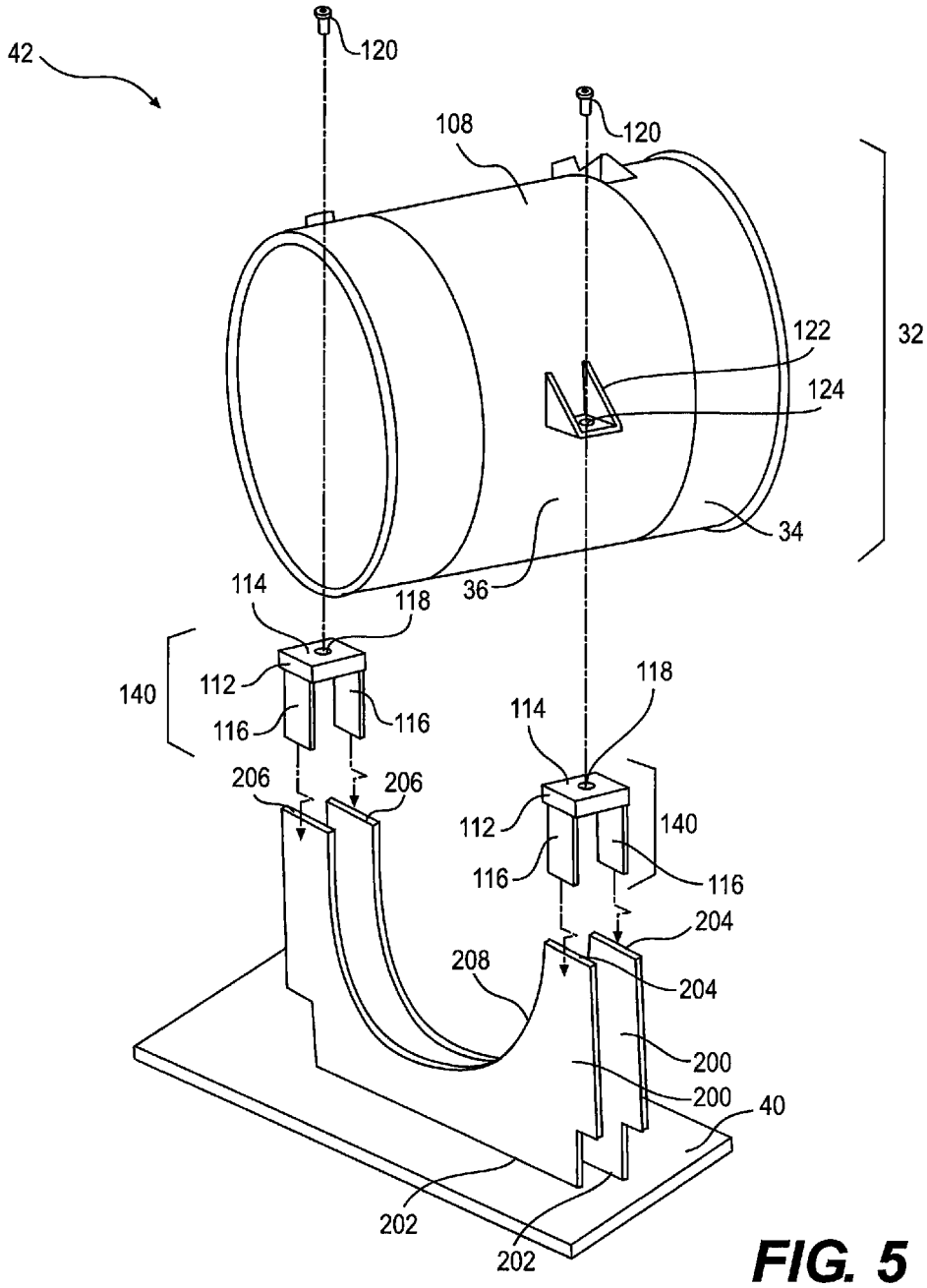

FIG. 5 illustrates another exemplary embodiment of adjustable support structure 42. In this disclosed embodiment, adjustable support structure 42 includes two plates 200. Further, brackets 140 may be attached to distal edges 204 and 206 of plates 200. First and second fasteners 120 may attach ears 122 on DPF 34 to brackets 140. The operation and construction of plates 200 and brackets 140 of FIG. 5 may be substantially identical to that of plates 100 and brackets 140 described above with reference to FIG. 3.

Figure 6:
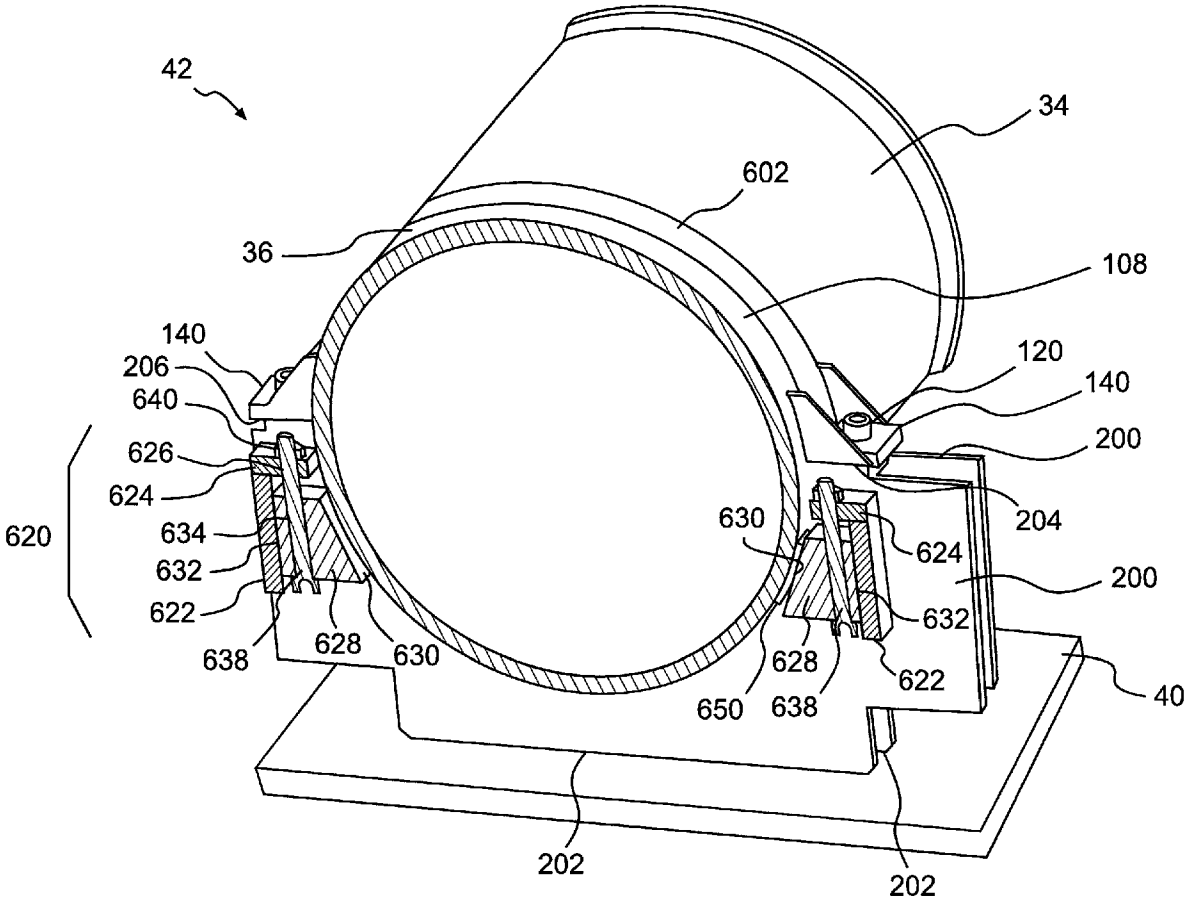

FIG. 6 illustrates another exemplary embodiment of adjustable support structure 42. In this disclosed embodiment, adjustable support structure 42 includes two plates 200. Further, brackets 140 may be attached to distal edges 204 and 206 of plates 200. The operation and construction of plates 200 and brackets 140 of FIG. 6 may be substantially identical to that of plates 100 and brackets 140 described above with reference to FIG. 3. DPF 36 may be receivable between distal edges 204 and 206 of plates 200, which may be shaped to receive DPF 36. A clamp 602 may be used to hold DPF 36 in position during operation of machine 10. Fasteners 120 may be used to attach clamp 602 to brackets 140. The exemplary disclosed adjustable support structure 42 of FIG. 6 may also include one or more adjustable brackets 620.

Adjustable bracket 620 may include a first member 622 attached to plate 200. Adjustable bracket 620 may also include a second member 624 attached to plate 200. First and second members 622, 624 may each be attached to plate 200 via fasteners, rivets, welds, or using any other appropriate means of attachment known in the art. Second member 624 may be disposed generally orthogonal to first member 622 and generally parallel to housing wall 40. Second member 624 may include a bore 626 which may be threaded. In one exemplary embodiment first and second members 622, 624 may be attached to each other via fasteners, rivets, welds, or using any other appropriate means of attachment known in the art. In another exemplary embodiment, first and second support members may constitute a single support member.

Adjustable bracket 620 may include a wedge member 628. Wedge member 628 may have a generally inclined surface 630 which may mate with pad 650. Inclined surface 630 may slidably move relative to pad 650. Pad 650 may be attached to outer surface 108 of DPF 36. Wedge member 628 may also include surface 632, opposite inclined surface 630. Surface 632 may be slidably attached to first member 622. Wedge member 628 may include a clearance bore 634. Fastener 638 may pass through bores 634 and 626. Fastener 638 may have threads, which may mate with threads in threaded bore 626. Adjustable bracket 620 may include a lock nut 640. Although, FIG. 6 illustrates an embodiment of adjustable support structure 42 which uses two plates 200, one skilled in the art would recognize that adjustable support structure 42 of FIG. 6 may be implemented using a single plate 200 and brackets 110 as shown in FIG. 4. Similarly, one skilled in the art would recognize that the adjustable support structure 42 of FIG. 6 may be implemented in combination with two or more of the adjustable support structures 42 illustrated in FIGS. 2 and 3.

INDUSTRIAL APPLICABILITY

The disclosed adjustable support structure may be used in any machine or power system application where DPFs are used together with DOCs to clean exhaust from an engine. In particular, the disclosed adjustable support structure may be used when one end of a DPF is fixedly attached to a DOC and the other end is supported by a support structure. The DOC itself may be fixedly attached to a wall of an exhaust passage. When one end of the DPF is fixedly attached to the DOC, the position and orientation of the DOC may govern the position of mating surfaces on DPF relative to corresponding mating surfaces on the support structure. The exemplary disclosed adjustable support structure allows for relative movement between its constituent components to ensure that the mating surfaces of a DPF may be aligned with the mating surfaces on the adjustable support structure. In particular, the adjustable support structure allows alignment of an opening on an ear attached to the DPF with an opening in the bracket so that a fastener can pass through both openings. After alignment is complete and the DPF has been attached to the adjustable support structure using the fastener, the moving components of the adjustable support structure may be welded together or may be fixedly attached to each other using fasteners or other attachment methods known in the art.

In addition to providing alignment capabilities, the exemplary disclosed adjustable support structure also protects the DPF and an associated DOC from thermally induced stresses. In particular, the exemplary disclosed adjustable support structure allows the DPF and DOC to expand in response to an increase in their operating temperature. By not restricting the dimensional changes in the DPF and DOC due to thermal expansion, the adjustable support structure may reduce or eliminate thermally induced stresses in the DPF and DOC.

As discussed above with regard to FIG. 2, legs 116 may be movably attached to mounting member 112. As a result, legs 116 may allow mounting member 112 to move in a horizontal and lateral direction in a plane of mounting member 112. Further, during assembly, mounting member 112 may be able to rotate in an angular direction about an axis of opening 118. Legs 116 may slidably connect with distal edge 104 of plate 100. As a result, during assembly, bracket 110 may be able to move vertically and laterally in the plane of plate 100. Thus, legs 116 and mounting member 112 may help make it easier to align a mating surface of DPF 36 with mounting surface 114 during assembly of DPF 36. Further, because adjustable support structure 42 permits the positional movements described above, it may not be necessary to maintain stringent tolerances on the mating parts thereby reducing the cost of manufacturing both the DPFs and the adjustable support structures. Additionally, the positional movements may make it possible to assemble any DPF in any DPF assembly location within the after-treatment system thereby eliminating the need to match specific DPFs to specific support structures in the engine.

Further, when a temperature of DOC 34 and DPF 36 increases from an ambient to an operating temperature, the physical dimensions of DOC 34 and DPF 36 may increase because of thermal expansion. In particular a length of DOC 34 and a length of DPF 36 may increase along a longitudinal axis of DOC 34 and DPF 36. The distal edge 104 of plate 100 may bend in a direction orthogonal to a plane of plate 100 and absorb the change in length. In this manner, plate 100 may reduce an amount of thermally induced stress in DOC 34 and DPF 36. Although the above description refers to FIG. 2, one skilled in the art would recognize that the exemplary embodiments of the adjustable support structure disclosed in FIGS. 3-5 would function in a similar manner to the adjustable support structure of FIG. 2.

Attachment of DPF 36 to plates 200 using the exemplary disclosed embodiment of adjustable structure 42 as illustrated in FIG. 6 will now be discussed. Adjustable bracket 620 in the embodiment of FIG. 6 may permit positional adjustment of DPF 36 with respect to housing wall 40. For example, when fastener 638 is turned in a clockwise or counter-clockwise direction, the mated threads of fastener 638 and bore 626 may cause wedge member 628 to move in a direction orthogonal with respect to housing wall 40. Movement of wedge member 628 may be guided by first member 622. Further, movement of wedge member 628 may be transferred to DPF 36 via pad 650. DPF 36 may move either towards or away from housing wall 40 depending on the direction of rotation of fastener 638. Thus fasteners 638 may be adjusted to move DPF 36 relative to housing wall 40 and to bring outer surface 108 of DPF 36 in contact with clamp 602. After the positional adjustment of DPF 36 with respect to housing wall 40 has been completed, lock nuts 640 may be tightened to help prevent further movement of DPF 36 with respect to housing wall 40. In this manner, clamp 602, brackets 140, and adjustable brackets 620 may cooperate to help ensure that DPF 36 may be attached to plates 200.

It will be apparent to those skilled in the art that various modifications and variations can be made to the disclosed adjustable support structure without departing from the scope of the disclosure. Other embodiments of the adjustable support structure will be apparent to those skilled in the art from consideration of the specification and practice of the adjustable support structure disclosed herein. It is intended that the specification and examples be considered as exemplary only, with a true scope of the disclosure being indicated by the following claims and their equivalents.

What is claimed is:

1. An adjustable support structure for an after-treatment component, comprising:

a housing wall;

a plate having a planar surface defined by a base edge fixedly connected to the housing wall, an accommodating edge shaped to receive a portion of the after-treatment component, and a distal edge;

a bracket connected to the plate at the distal edge and configured to engage the after treatment component; and first and second legs extending from the bracket toward the housing wall, wherein the first and second legs are spaced apart from each other to receive the distal edge of the plate therebetween, wherein the plate and the bracket are configured to support the after-treatment component in a position such that the after-treatment component is spaced from the housing wall.

2. The adjustable support structure of claim 1, wherein the first and second legs are disposed generally orthogonal to the bracket.

3. The adjustable support structure of claim 2, wherein the first and second legs are movably connected to the bracket.

4. The adjustable support structure of claim 3, wherein the first and second legs are movable relative to the plate.

5. The adjustable support structure of claim 4, further including a fastener configured to pass through the bracket and engage the after-treatment component.

6. The adjustable support structure of claim 5, wherein the accommodating edge is shaped to match an outer surface of the after-treatment component.

7. The adjustable support structure of claim 6, wherein the plate is a first plate;

the adjustable support structure further includes a second plate spaced apart from the first plate; and the first and second legs are spaced apart to receive the first and second plates therebetween.

8. The adjustable support structure of claim 6, wherein the distal edge of the plate is a first distal edge;

the plate further includes a second distal edge spaced apart from the first distal edge such that the after-treatment component is receivable between the first and second distal edges;

the bracket is a first bracket connected to the first distal edge; and the adjustable support structure further includes a second bracket connected to the second distal edge.

9. An adjustable support structure for an after-treatment component, comprising:

a housing wall;

a first plate having a base edge, a first distal edge, and a second distal edge;

a second plate having a base edge, a first distal edge, and a second distal edge, wherein the second plate is spaced apart from the first plate;

a first bracket connected to the first and second plates at the first distal edges and configured to engage the after-treatment component;

a second bracket connected to the first and second plates at the second distal edges and configured to engage the after-treatment component;

first and second legs extending from the first bracket towards the housing wall, wherein the first and second legs are spaced apart from each other to receive the first distal edges of the first and second plates therebetween; and third and fourth legs extending from the second bracket towards the housing wall wherein the third and fourth legs are spaced apart from each other to receive the second distal edges of the first and second plates therebetween.

10. The adjustable support structure of claim 9, wherein the first and second legs are disposed generally orthogonal to the first bracket, and the third and fourth legs are disposed generally orthogonal to the second bracket.

11. The adjustable support structure of claim 10, wherein the first and second legs are movably connected to the first bracket, and the third and fourth legs are movably connected to the second bracket.

12. The adjustable support structure of claim 11, wherein the first and second legs are movable relative to the first and second plates, and the third and fourth legs are movable relative to the first and second plates.

13. The adjustable support structure of claim 12, further including:

a first fastener configured to pass through the first bracket and engage the after-treatment component; and a second fastener configured to pass through the second bracket and engage the after-treatment component.

14. An exhaust system, comprising:

a housing having an end wall and a housing wall;

an after-treatment component being fixedly attached at one end thereof to the end wall;

a plate having a base edge fixedly connected to the housing wall and a distal edge;

a bracket connected to the distal edge of the plate and configured to engage the after treatment component; and first and second legs extending from the bracket towards the housing wall, wherein the first and second legs are spaced apart from each other to receive the distal edge of the plate therebetween, wherein the plate and the bracket support the after-treatment component in a position such that the after-treatment component is spaced from the housing wall.

15. The exhaust system of claim 14, wherein the first and second legs are disposed generally orthogonal to the bracket.

16. The exhaust system of claim 15, wherein the first and second legs are movably connected to the bracket.

17. The exhaust system of claim 16, wherein the first and second legs are movable relative to the plate.

18. The exhaust system of claim 17, further including a fastener configured to pass through the bracket and engage the after-treatment component.

19. The exhaust system of claim 18, wherein the plate is a first plate;

the exhaust system further includes a second plate spaced apart from the first plate; and the first and second legs are spaced apart to receive the first and second plates therebetween.

20. The exhaust system of claim 19, wherein the distal edge of the plate is a first distal edge;

the plate further includes a second distal edge spaced apart from the first distal edge such that the after-treatment component is receivable between the first and second distal edges;

the bracket is a first bracket connected to the first distal edge; and the exhaust system further includes a second bracket connected to the second distal edge.

* * * * *